US005272988A

United States Patent [19]

Kelley et al.

[11] Patent Number: 5,272,988

[45] Date of Patent: Dec. 28, 1993

[54] DESK WITH CABLE MANAGEMENT

[75] Inventors: James O. Kelley, Spring Lake; Douglas M. DeHaan, Grand Haven, both of Mich.

[73] Assignee: Herman Miller, Inc., Zeeland, Mich.

[21] Appl. No.: 694,316

[22] Filed: May 1, 1991

[51] Int. Cl.[5] ..... A47B 35/00

[52] U.S. Cl. ..... 108/50; 312/223.6

[58] Field of Search ..... 108/50; 312/223.6, 223.5

[56] References Cited

U.S. PATENT DOCUMENTS

| | | | |
|---|---|---|---|
| 2,942,924 | 6/1960 | Stangert . | |
| 3,635,174 | 1/1972 | Ball et al. . | |
| 3,873,758 | 3/1975 | VanGessel et al. | 174/48 |
| 3,883,202 | 5/1975 | Konig . | |
| 3,892,095 | 7/1975 | Vankuik et al. . | |
| 3,922,045 | 11/1975 | Meyer | 312/108 |
| 4,094,256 | 6/1978 | Holper et al. . | |
| 4,094,561 | 6/1978 | Wolff et al. . | |
| 4,155,310 | 5/1979 | Gregory . | |
| 4,163,867 | 8/1979 | Breidenbach | 174/48 |
| 4,296,981 | 10/1981 | Hildebrandt et al. | 312/223.6 X |
| 4,323,291 | 4/1982 | Ball | 312/194 |
| 4,372,629 | 2/1983 | Propst et al. | 312/223 |
| 4,433,630 | 2/1984 | Laborie | 108/50 |
| 4,535,703 | 8/1985 | Henriott et al. . | |
| 4,734,826 | 3/1988 | Wilson et al. | 361/428 |
| 4,762,072 | 8/1988 | Boundy et al. | 108/50 |
| 4,827,850 | 5/1989 | Diffrient | 108/50 X |
| 4,838,175 | 6/1989 | Hauville | 108/50 X |
| 4,875,418 | 10/1989 | Moeckl et al. | 108/50 |
| 4,879,955 | 11/1989 | Moll et al. | 108/50 |
| 4,948,205 | 8/1990 | Kelley | 108/50 |
| 5,024,167 | 6/1991 | Hayward | 108/50 |
| 5,144,896 | 9/1992 | Fortsch . | |

FOREIGN PATENT DOCUMENTS

| | | |
|---|---|---|
| 197810 | 10/1978 | Fed. Rep. of Germany . |
| 2555423 | 5/1985 | France . |

*Primary Examiner*—Jose V. Chen

*Attorney, Agent, or Firm*—Willian Brinks Hofer Gilson & Lione

[57] ABSTRACT

A desk includes a horizontal worksurface having a top surface, an underside, and a plurality of side edges. At least one vertical panel is positioned below said worksurface parallel to a side edge thereof. A top edge of the panel is lower than the underside of the worksurface to provide a clearance such that cables may be inserted therebetween at a desired location along the length thereof. A trough is positioned adjacent an inner surface of the panel and is substantially the same length as the panel. The trough includes an access opening therein and a back wall which is spaced apart from the panel and has a top edge adjacent the underside of the worksurface. In one aspect of the invention, the access opening is formed in the back wall of the trough and a flexible cover is attached thereto such that the access opening is substantially covered. The cover has a plurality of vertical slits which divide the cover into a plurality of flaps for the insertion of cables. In another aspect the access opening is formed in the back wall and the worksurface has a cavity formed in the underside thereof in a position overlying the access opening. The cavity spans at least the distance between the top edge of the back wall and the vertical panel.

34 Claims, 4 Drawing Sheets 16
25
20
34
24
44
14
50
28
48
26
32
22
52
65
38
45
68
60
39
30
62
36
42
46
40
56
70

DESK WITH CABLE MANAGEMENT

BACKGROUND OF THE INVENTION

The present invention relates generally to office furniture such as desks or the like, and more particularly, to a desk having cable management features.

Many types of equipment used in modern offices, such as telephones, computers, typewriters, etc., are positioned on the worksurfaces of desks. In order for these devices to function, data, communication and/or electrical cables must be provided. These cables and their connecting elements can be unsightly and cumbersome when loosely placed on the top of a worksurface, draped over the side of the desk, and strewn about a floor.

In existing desks with cable management, wires or cables are often fed through an access opening in the worksurface or the support panels of a desk, and some type of cover is utilized to conceal the access opening. Desks of this type are disclosed in U.S. Pat. Nos. 4,762,072 (Boundy), 4,734,826 (Wilson), 4,372,629 (Propst), 4,323,291 (Ball), 4,296,981 (Hildenbrandt), 4,163,867 (Breidenbach), and 3,873,758 (VanGessel). Even when the cables themselves are hidden from view, the covers of these desks can be readily observable and unattractive, especially when the covers are located on the top of a worksurface.

A desirable feature of cable management is to have one or more access openings spanning the substantial length of the panel or worksurface so that cables can be inserted therein from a desired location on the worksurface. In such a case, the length of exposed cable from various office equipment to the access opening is minimized. However, these added access openings compound the problem of providing an attractive desk with inconspicuous covers or the like. Boundy, Wilson, and Propst disclose such access openings in the worksurface which span the substantial length thereof. The plurality of covers or the like concealing these openings, however, can be noticeable and unattractive.

SUMMARY OF THE INVENTION

Briefly stated, the invention is directed to a desk having cable management features. The desk includes a horizontal worksurface having a top surface, an underside, and a plurality of side edges. At least one vertical panel is positioned below the worksurface parallel to a side edge thereof. A top edge of the panel is lower than the underside of the worksurface. Cables pass between the panel and the worksurface at a desired location along the length thereof. In addition, a trough is positioned adjacent an inner surface of the panel and is substantially the same length as the panel for the laying of cables therein at a desired location. The trough has an access opening therein and a back wall which is spaced apart from the panel. A top edge of the back wall is adjacent the underside of the worksurface.

In one aspect of the invention, the access opening is formed in the back wall of the trough and a flexible, resilient cover is attached to the back wall such that the access opening is substantially covered. The cover has a plurality of vertical slits therein which divide the cover into vertical flaps for receiving the cables.

In another aspect of the invention, the access opening is formed in the back wall of the trough and the worksurface has a cavity formed in the underside thereof in a position overlying the access opening. The cavity spans at least the horizontal distance between the top edge of the back wall and the vertical panel. In addition, the cover may be attached to the back wall in this form of the invention. When a cover is provided, the flaps bend to receive connectors, plugs or the like attached to the cables, return to an upright position, and the cables lie on a top edge of the cover in the cavity.

In yet another aspect of the invention, the access opening is formed in a bottom wall of the trough. The bottom wall is positioned between the back wall and the panel below the top edge of the panel.

In a preferred embodiment, the access opening in the back wall of the trough comprises a rectangular slot formed in the upper portion of the back wall. The slot is preferably positioned substantially in the longitudinal center of the back wall. In another preferred embodiment, the access opening in the bottom wall is rectangular and positioned substantially in the longitudinal center of the bottom wall. In the forms of the invention including the cover, an exterior surface of the panel and the cover are preferably the same dark color in order to make the cover inconspicuous.

The present invention provides significant advantages over other desks with cable management. The clearance between the panel and worksurface allows cables to pass therethrough from a desired location along the edge of the worksurface, thus minimizing the length of exposed cable from various office equipment to the trough. The configuration of the panel in relation to the worksurface is uniform and attractive, thus eliminating the need to provide a conspicuous cover for concealing traditional access openings. The access opening in the trough is similarly unobtrusive. In the preferred embodiment incorporating the flexible cover and cavity, the flaps in the cover and the fact that the cover is spaced apart from the panel minimize the obtrusiveness of the access opening and cover. In the embodiment incorporating the access opening in the bottom wall of the trough, the opening is completely hidden from view. In addition, the cavity provides added clearance for the insertion of connectors or plugs therein, thus minimizing the clearance between the panel and worksurface.

The present invention, together with further objects and advantages, will be best understood by reference to the following detailed description taken in conjunction with the accompanying drawings.

DETAILED DESCRIPTION OF THE PREFERRED EMBODIMENTS

Figure 1:
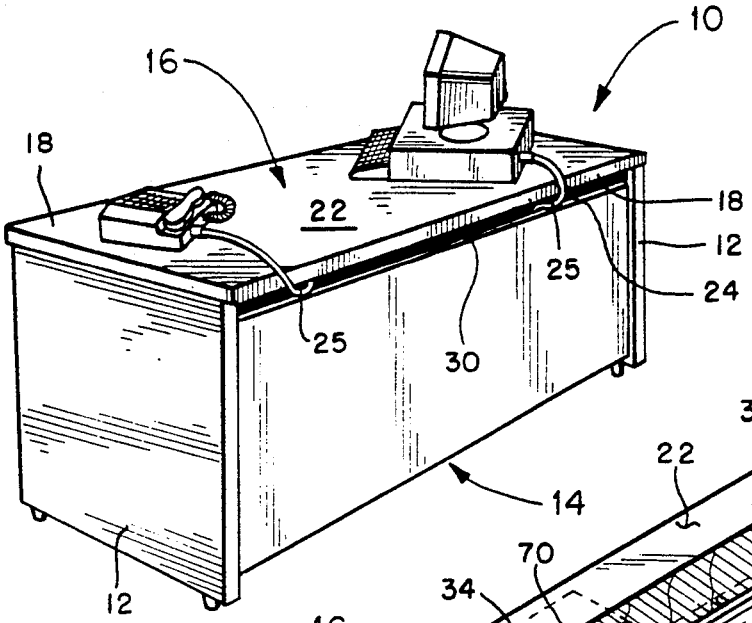
FIG. 1 is a perspective view of a preferred embodiment of the invention showing an external view of the front of a desk.

Referring to the drawings, FIG. 1 shows a preferred embodiment of a desk with cable management indicated generally at 10. The desk 10 includes vertical side panels 12 and a vertical front panel 14 positioned below a horizontal worksurface 16. The worksurface 16 has a plurality of side edges 18, an underside 20, and a top surface 22 whereupon office equipment such as computers, telephones, or the like are placed. The desk 10 may include any number of panels and the worksurface 16 may be supported by some of the panels or by vertical support members (not shown).

Figure 2:
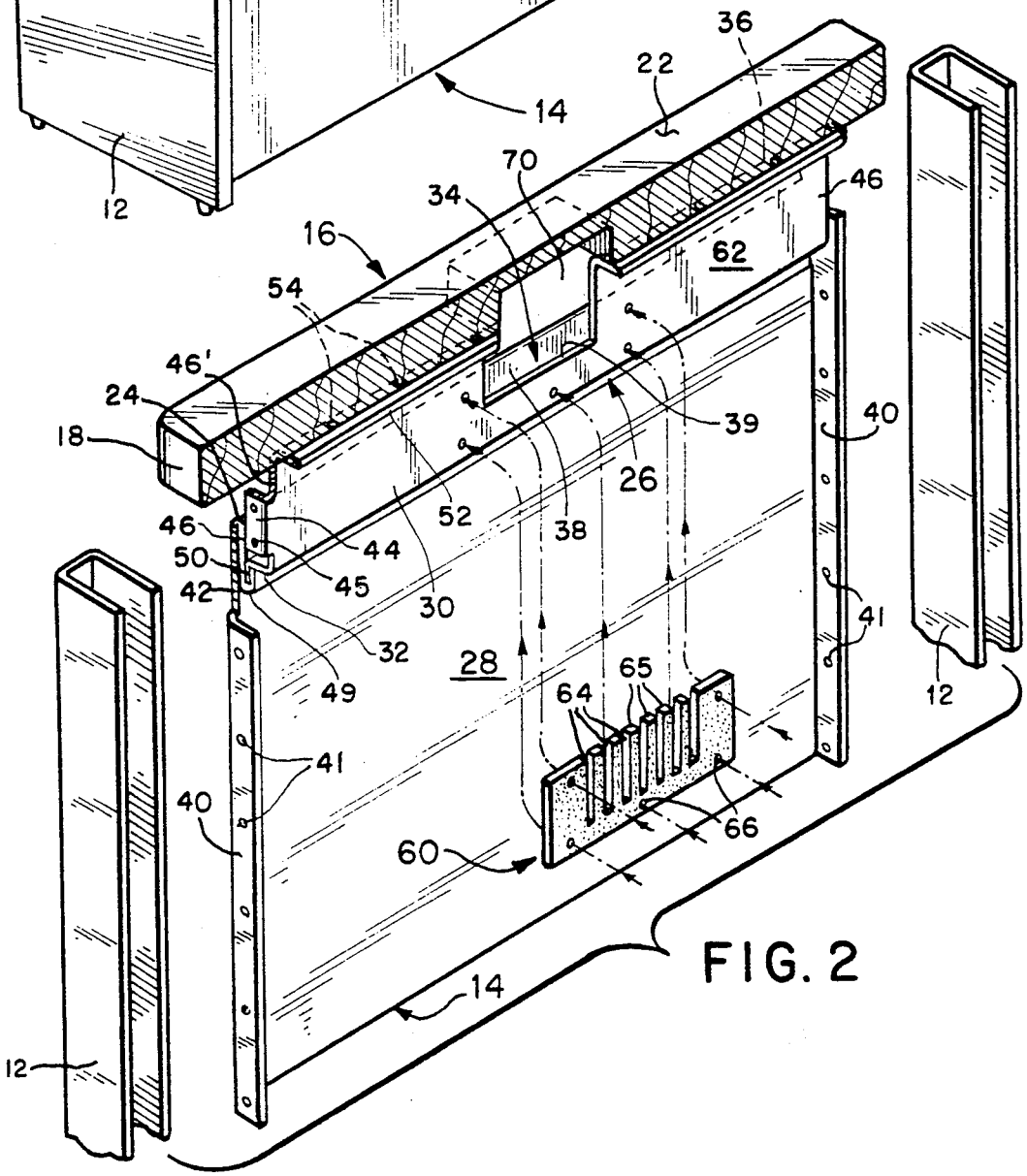
FIG. 2 is a perspective view a preferred embodiment of the invention showing a worksurface in section, the inside of a front panel, and a trough.
Figure 3:
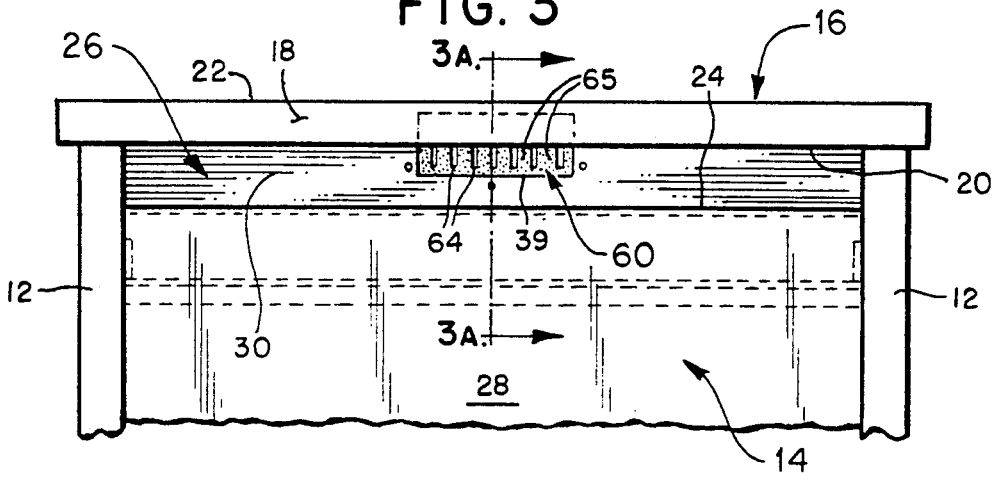
FIG. 3 is a front view of a preferred embodiment of the invention showing a cavity in dotted lines and a cover over an access opening.

Referring to FIGS. 1-3, front panel 14 is parallel to the side edge 18 of worksurface 16. A top edge 24 of front panel 14 is lower than the underside 20 of worksurface 16 so that a plurality of cables 25 may be passed therethrough at a desired location along the length of the worksurface 16. Top edge 24 is preferably horizontal to provide a uniform, attractive opening which does not need to be concealed.

A trough 26 is positioned adjacent an inner surface 28 of panel 14 and is substantially the same length as the panel. Trough 26 includes a vertical back wall 30 which is spaced apart from panel 14 and a horizontal bottom wall 32 therebetween to create an interior channel 34. To provide a uniform and attractive surface for a person viewing the front of desk 10, a top edge 36 of back wall 30 is adjacent the underside 20 of worksurface 16. The back wall 30 is preferably a dark color, such as black, to make the wall inconspicuous. Back wall 30 also has an access opening 38 therein to allow cables 25 to reach a desired position underneath the worksurface 16. The access opening 38 is preferably a rectangular slot having a bottom edge 39. Preferably, access opening 38 is formed in an upper portion of the back wall 30 in the longitudinal center thereof.

To secure the trough 26 to a position adjacent the front panel 14, vertical flanges 40 extend inward from side edges 42 of the front panel 14, and vertical flanges 44 extend toward panel 14 from ends 46 of the back wall 30. The panel flanges 40 include a plurality of apertures 41 therein, and the back wall flanges 44 include a plurality of apertures 45 therein. The back wall flanges 44 bear against an inner surface of the panel flanges 40 such that apertures 41 and 43 are in alignment for receiving conventional fasteners.

To further secure the trough 26, the panel 14 includes a folded over portion 48 extending downward from the top edge 24 thereof. The folded portion 48 terminates in an anchor member 49 which bends upward to create a seat. Vertical flange 50, which depends from the bottom wall 32 of trough 16, mates with anchor member 49.

To secure trough 26 yet further, a horizontal flange 52 extends from the top edge 36 of back wall 30 in a direction away from panel 14. The flange 52 bears against the underside 20 of the worksurface 16 and has a plurality of apertures 54 therein for receiving a plurality of fasteners 56.

The trough 26 can be of any configuration which retains a plurality of cables. For example, bottom wall 32 need not be provided if the back wall 30 is curved or slanted toward the panel 14. Although the preferred material for the trough 26 is metal, any suitable material may be used. Preferably, fasteners 56 comprise rivets, but any conventional fasteners can be used, such as screws, bolts, or the like. In addition, the trough can be attached by conventional fastening means to any combination of the side panels 12, front panel 14, and/or worksurface 16. Furthermore, the trough may include a plurality of access openings therein of any shape and in any location to allow cables to reach a position underneath the worksurface.

A flexible, resilient cover 60 is attached to a back surface 62 of the back wall 30 such that the access opening 38 is substantially covered. Cover 60 has a plurality of vertical slits 64 therein which divide the cover into vertical flaps 65. The vertical flaps 65 bend so that connectors, plugs or the like attached to cables 25 can be inserted therethrough. The cover 60 also includes a plurality of apertures 66 therein for receiving a plurality of fasteners 68. The cover 60 may have any type of opening therein which allows the cables 25 to be inserted therethrough, although it is desirable to make such openings inconspicuous to a person viewing the desk 10. Preferably, fasteners 68 comprise rivets, but any conventional fastening means can be used for attaching the cover 60 to the back wall 30, such as screws, bolts, adhesive, Velcro ® or the like. In addition, cover 60 may be attached to the surface of back wall 30 opposite the back surface 62.

The underside 20 of worksurface 16 includes a cavity formed therein in a position overlying the back wall access opening 38. Cavity 70 is spaced apart from the side edge 18 of worksurface 16 and spans at least the horizontal distance between the top edge 36 of back wall 30 and panel 14. Preferably, cavity 70 is the same width as the access opening 38. Cavity 70 provides added clearance for the insertion of cables 25 and any connectors, plugs, or the like into the trough 26, thus minimizing the clearance between panel 14 and the worksurface 16. In addition, the added clearance provided by cavity 70 allows the bottom edge 39 of access opening 38 to be relatively high. After connectors attached to cables 25 are inserted past the plane of cover 60, a portion of the cables 25 are raised to a position above the cover and inside cavity 70, and the flaps 25 return to a vertical position. Thus, the cables 25 are hidden from view and the cover 60 is inconspicuous.

Figure 4:
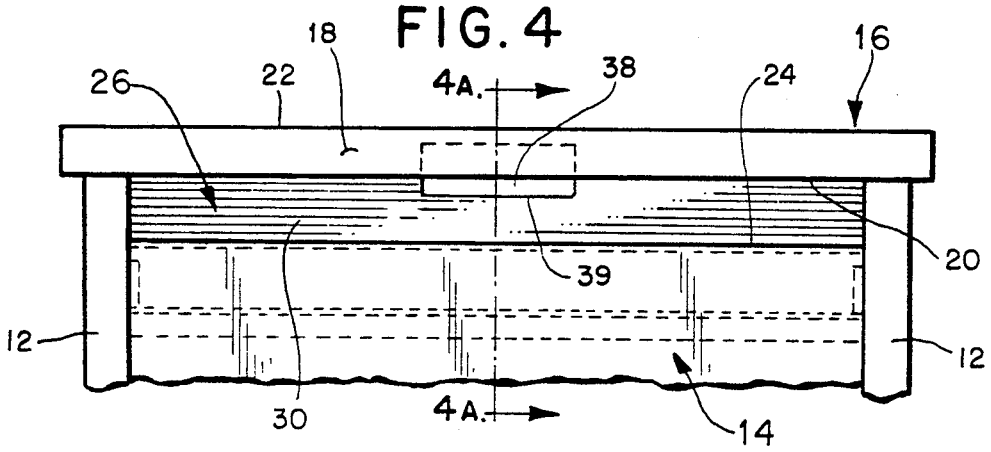
FIG. 4 is a front view of an alternative embodiment of the invention showing the cavity in dotted lines and the access opening.
Figure 5:
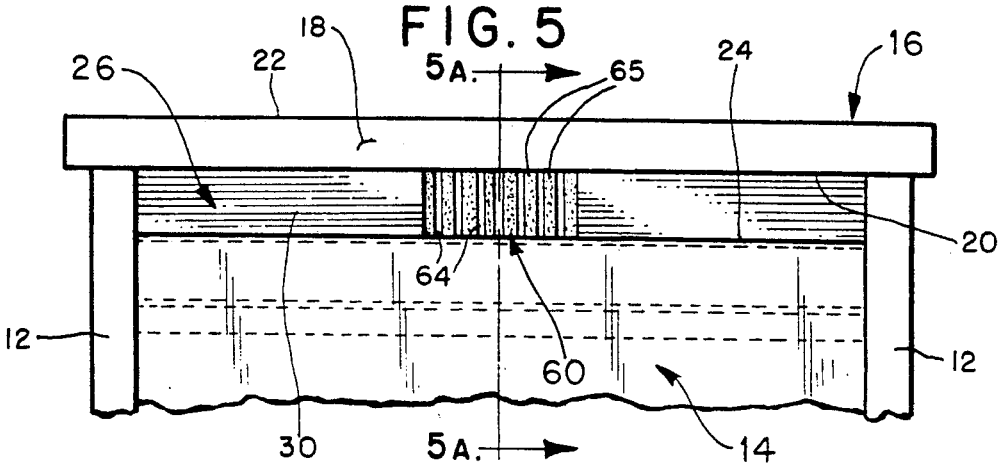
FIG. 5 is a front view of another alternative embodiment of the invention showing the cover over the access opening.
Figures 3A, 4A, 5A:
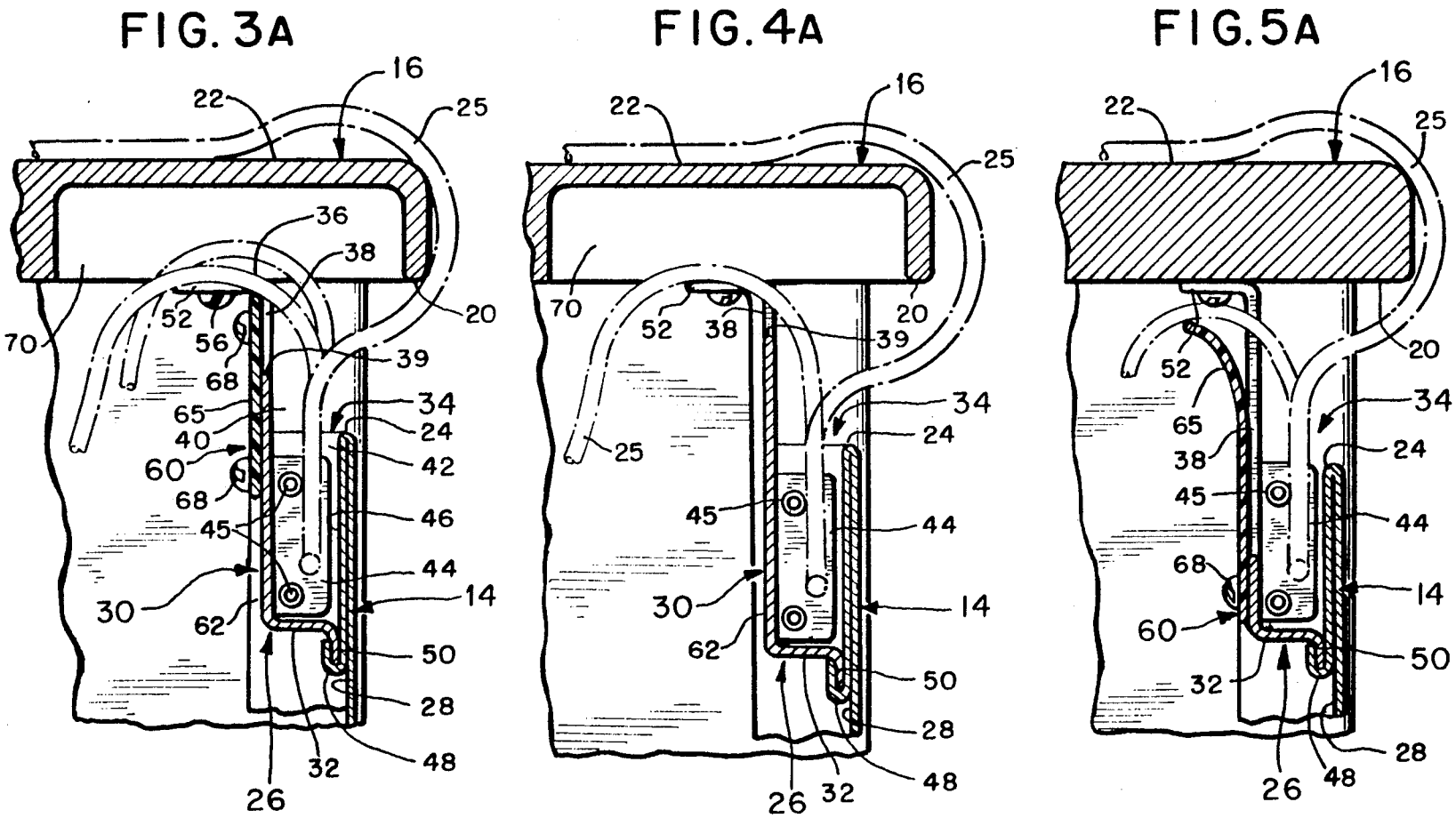
FIG. 3A is a cross-sectional view of the embodiment shown in FIG. 3 taken along the line 3A—3A.
FIG. 4A is a cross-sectional view of the embodiment shown in FIG. 4 taken along the line 4A—4A.
FIG. 5A is a cross-sectional view of the embodiment shown in FIG. 5 taken along the line 5A—5A.

In the embodiment of the invention shown in FIG. 4, cover 60 is not provided since the bottom edge 39 of access opening 38 is high enough to prevent a person from seeing the access opening. In the embodiment shown in FIG. 5, cavity 70 is not provided since the top edge 24 of panel 14 and the bottom edge 39 of access opening 38 are low enough to accommodate cables 25 and their connected components.

Figure 6:
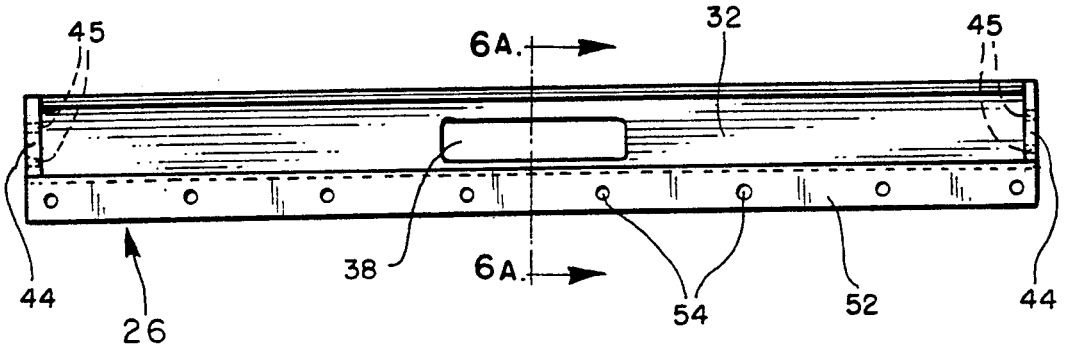
FIG. 6 is a top view of yet another alternative embodiment of the invention showing the access opening in a bottom wall of the trough.
Figure 6A:
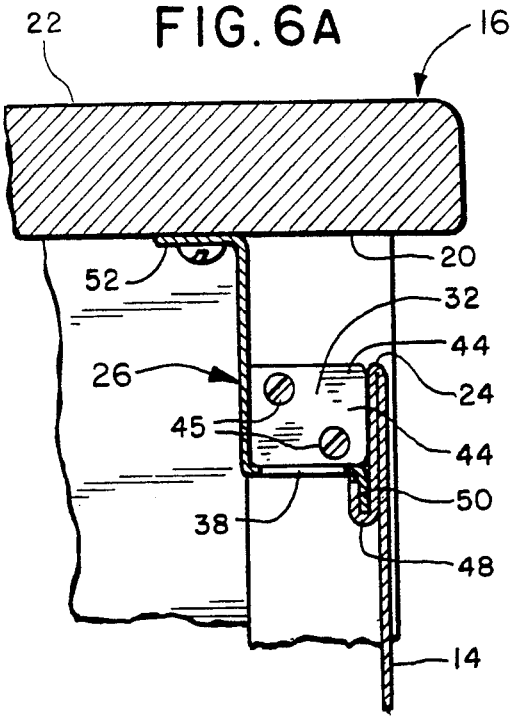
FIG. 6A is a cross-sectional view of the embodiment shown in FIG. 6 taken along the line 6A—6A.

In another embodiment of the invention, access opening 38 is formed in the bottom wall 32 of trough 26, as shown in FIG. 6. In this form of the invention, the access opening 38 is completely concealed and cover 60 need not be provided.

In all forms of the invention, a plurality of cables 25 from various office equipment positioned on the top surface 22 of worksurface 16 are passed over side edge 18 at a desired location. The cables are inserted into the clearance between the panel 14 and worksurface 16, and laid in the trough 26. If cavity 70 is provided and the top edge 24 of panel 14 is relatively high, connectors, plugs or the like are inserted through the cavity, and the cables are then moved along the length of trough 26 to minimize the amount of cable exposed on the top surface 22 of worksurface 16. If the cover 60 is utilized, the cables 25 and any connected components are forced past the flaps 65, a portion of the cables is raised into cavity 70, and the flaps 65 return to a vertical position to provide an inconspicuous viewing surface. If the cover 60 is not utilized, the cables are inserted through the access opening 38. If any event, cables 25 are then directed to a desired location below the worksurface 16, such as a power source on a floor. In addition, the cables are loosely arranged in the trough 16 to minimize the exposure thereof outside the trough. Although the invention has been described with reference to front panel 14 and the corresponding side edge 18 of the worksurface 16, it may be readily incorporated into any panel of the desk 10.

Thus, a desk with efficient, inconspicuous cable management features is provided. The uniform clearance between the panel 14 and the worksurface 16, when viewed with the back wall 30 of trough 26 as a receded surface, provides an attractive access opening for the cables 25 while allowing the cables to be placed therein from any location along the length of the worksurface 16. In addition, the cavity 70 in worksurface 16 allows the top edge 24 of panel 14 and the bottom edge 39 of back wall access opening 38 to be relatively high and inconspicuous. If the access opening 38 is low enough for a person to see, the cover 60 is provided to conceal the access opening. Cavity 70 provides a space for the cables 25 to lie in so that flaps 65 of cover 60 can return to a vertical, inconspicuous position. Furthermore, if the access opening 38 is formed in the bottom wall 32 of trough 26, the opening is completely concealed.

Although the present invention has been described with reference to preferred embodiments, workers skilled in the art will recognize that many changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

I claim:

1. A desk with cable management comprising:

a horizontal worksurface having a top surface, an underside, and a plurality of side edges;

at least one vertical panel positioned below said worksurface parallel to a side edge thereof said panel having a top edge lower than the underside of the worksurface to provide a clearance which is positioned laterally inwardly from said side edge such that cables may pass therebetween at a desired location along said length; and a trough having a length substantially the same as the panel and being positioned adjacent an inner surface of said panel, the trough having an access opening therein for the insertion of cables to a position underneath the worksurface and at least a back wall spaced apart from said panel, said back wall having a top edge adjacent the underside of the worksurface;

whereby a plurality of cables from various office equipment positioned on the top surface of the worksurface are passed over the side edge thereof at a desired location, inserted into the clearance between the panel and worksurface, laid in the trough, inserted through the access opening, and passed to a desired location below the worksurface, with any excess length of cable being laid in the trough to minimize the length of cable outside the trough.

2. The apparatus of claim 1, wherein the access opening is formed in the back wall.

3. The apparatus of claim 2, wherein the access opening is substantially in the longitudinal center of the back wall.

4. The apparatus of claim 3, wherein the access opening comprises a rectangular slot formed in an upper portion of the back wall.

5. The apparatus of claim 4, wherein the trough back wall is substantially vertical and the bottom wall is substantially horizontal.

6. The apparatus of claim 1, wherein the access opening is formed in a bottom wall between the back wall and the panel, said bottom wall being positioned below the top edge of the panel.

7. The apparatus of claim 6, wherein the access opening is substantially in the longitudinal center of the bottom wall.

8. The apparatus of claim 7, wherein the trough back wall is substantially vertical and the bottom wall is substantially horizontal.

9. A desk with cable management comprising:

a horizontal worksurface having a top surface, an underside, and a plurality of side edges;

at least one vertical panel positioned below said worksurface parallel to a side edge thereof, said panel having a top edge lower than the underside of the worksurface to provide a clearance such that cables may pass therebetween at a desired location along said length;

a trough positioned adjacent an inner surface of said panel, the trough having a back wall spaced apart from the panel and a length substantially the same as the panel for the laying of cables therein at a desired location, said back wall having a top edge adjacent the underside of the worksurface and an access opening therein so that cables can reach a desired position underneath the worksurface; and a flexible, resilient cover attached to the back wall of the trough and extending across the access opening to substantially cover said opening, said cover having a plurality of vertical slits therein extending from one of a top edge and bottom edge thereof to divide the cover into a plurality of vertical flaps;

whereby a plurality of cables from various office equipment positioned on the top surface of the worksurface are passed over the side edge thereof at a desired location, inserted into the clearance between the panel and worksurface, laid in the trough, inserted past a flap in the access opening cover, and passed to a desired location below the worksurface, with any excess length of cable being laid in the trough to minimize the length of cable outside the trough.

10. The apparatus of claim 9, wherein the worksurface has a cavity formed in the underside thereof in a position overlying the back wall access opening, the cavity being spaced apart from the side edge of the worksurface and spanning at least the distance between the top edge of the back wall and the vertical panel, whereby cables and connectors attached thereto are inserted into the cavity, a first portion of the cables are laid in the trough, the cover flaps are bent inward to receive the connectors, a second portion of the cables are raised to a position overlying the cover and inside the cavity, and the flaps return to a vertical position.

11. The apparatus of claim 10, wherein the worksurface cavity is substantially the same width as the access opening.

12. The apparatus of claim 9, wherein the access opening is substantially in the longitudinal center of the back wall.

13. The apparatus of claim 12, wherein the access opening comprises a rectangular slot formed in an upper portion of the back wall.

14. The apparatus of claim 13, wherein an exterior surface of the panel is a dark color, and the access opening cover is the same color as the panel.

15. The apparatus of claim 14, wherein the trough comprises a vertical back wall spaced apart from the panel and a horizontal bottom wall therebetween to create an interior channel.

16. The apparatus of claim 15, wherein the trough is attached to the desk by fastening means comprising vertical flanges extending inward from side edges of the panel, and first vertical flanges extending from the ends of the back wall toward the panel, said panel flanges and trough first vertical flanges having a plurality of apertures therein in alignment to receive a plurality of fasteners, the fastening means also comprising an anchor member extending upward from the inner surface of the panel and a second vertical flange depending from the bottom wall of the trough, said second vertical flange mating with said anchor member to secure the trough to the panel.

17. The apparatus of claim 16, wherein the fastening means further comprises a horizontal flange extending from the top edge of the back wall away from the panel, said flange bearing against the underside of the worksurface and having a plurality of apertures therein for receiving a plurality of fasteners.

18. A desk with cable management including a horizontal worksurface having a top surface, an underside, and a plurality of side edges, the desk comprising:

at least one vertical panel positioned below said worksurface parallel to a side edge thereof, said panel having a top edge lower than the underside of the worksurface to provide a clearance such that cables may pass therebetween at a desired location along said length;

a trough positioned adjacent an inner surface of said panel, the trough having a back wall spaced apart from the panel, a length substantially the same as the panel for the laying of cables therein at a desired location, and an access opening therein so that cables can reach a desired position underneath the worksurface; and the underside of said horizontal worksurface having a cavity formed therein in a position overlying one of the panel and the back wall of the trough the cavity being spaced apart from the side edge of the worksurface;

whereby a plurality of cables from various office equipment positioned on the top surface of the worksurface are passed over the side edge thereof at a desired location, inserted into the clearance between the panel and the worksurface, laid in the trough, inserted through the access opening in the trough, and passed to a desired location below the worksurface, with any excess length of cable being laid in the trough to minimize the length of cable outside the trough.

19. The apparatus of claim 18, wherein the access opening comprises a rectangular slot formed in an upper portion of the back wall.

20. The apparatus of claim 19, wherein the slot is positioned substantially in the longitudinal center of the back wall.

21. The apparatus of claim 20, wherein the worksurface cavity is substantially the same width as the slot.

22. The apparatus of claim 21, wherein the trough comprises a vertical back wall spaced apart from the panel and a horizontal bottom wall therebetween to create an interior channel.

23. The apparatus of claim 19, further comprising a flexible, resilient cover attached to the back wall of the trough and extending across the slot to substantially cover said slot, said cover having a plurality of vertical slits therein extending from one of a top edge and bottom edge thereof to divide the cover into a plurality of vertical flaps, whereby the cables and connectors attached thereto are inserted past the flaps, raised to a position overlying the flaps and inside the cavity, and the flaps return to a vertical position.

24. The apparatus of claim 23, wherein an exterior surface of the panel is a dark color, and the access opening cover is the same color as the panel.

25. The apparatus of claim 24, wherein the trough is attached to the desk by fastening means comprising vertical flanges extending inward from side edges of the panel, and first vertical flanges extending from the ends of the back wall toward the panel, said panel flanges and trough first vertical flanges having a plurality of apertures therein in alignment to receive a plurality of fasteners, the fastening means also comprising an anchor member extending upward from the inner surface of the panel and a second vertical flange depending from the bottom wall of the trough, said second vertical flange mating with said anchor member to secure the trough to the panel.

26. The apparatus of claim 25, wherein the fastening means further comprises a horizontal flange extending from the top edge of the back wall away from the panel, said flange bearing against the underside of the worksurface and having a plurality of apertures therein for receiving a plurality of fasteners.

27. A desk with cable management including a horizontal worksurface having a top surface, an underside, and a plurality of side edges, the desk comprising:

at least one vertical panel positioned below said worksurface parallel to a side edge thereof, said panel having a top edge lower than the underside of the worksurface to provide a clearance such that cables may pass therebetween at a desired location along said length;

a trough attached to a top portion of the inner surface of said vertical panel for the laying of cables therein, the trough being substantially the same length as the panel and having a vertical back wall spaced apart from said panel and a horizontal bottom wall therebetween to create an interior channel, said bottom wall being positioned below the top edge of the panel, and said back wall having a top edge adjacent the underside of the worksurface and a rectangular slot in the longitudinal center thereof so that cables can reach a position underneath the worksurface;

a flexible, resilient cover attached to the back wall of the trough and extending across the access opening to substantially cover said slot, said cover having a plurality of vertical slits therein extending from one of a top edge and bottom edge thereof to divide the cover into a plurality of vertical flaps; and the horizontal worksurface having a cavity formed in the underside thereof in a position overlying the back wall slot, the cavity being substantially as wide as the slot, spaced apart from the side edge of the worksurface, and spanning at least the horizontal distance between the top edge of the back wall and the vertical panel;

whereby a plurality of cables from various office equipment positioned on the top surface of the worksurface are passed over the side edge thereof at a desired location, inserted into the clearance between the panel and a top surface of the cavity, laid in the trough, inserted past the cover flaps, and passed to a desired location below the worksurface, a portion of the cables being raised to a position overlying the flaps and inside the cavity so that the flaps return to a vertical position, and any excess length of cable being laid in the trough to minimize the length of cable outside the trough.

28. The apparatus of claim 27, wherein an exterior surface of the panel is a dark color, and the access opening cover is the same color as the panel.

29. The apparatus of claim 28, further comprising a horizontal flange extending from the top edge of the back wall away from the panel to provide a seat for the worksurface, said flange having a plurality of apertures therein for receiving a plurality of fastener to secure the trough to the underside of the worksurface.

30. The apparatus of claim 29, wherein the panel is made of sheet metal and has vertical flanges extending inward from side edges thereof, and the trough has first vertical flanges extending from the ends of the back wall toward the panel, said panel flanges and trough first vertical flanges having a plurality of apertures therein in alignment to receive a plurality of fasteners.

31. The apparatus of claim 30, wherein the panel has an anchor member extending from the inner surface thereof, and the trough has a second vertical flange depending from the bottom wall thereof, said second vertical flange mating with said anchor member to further secure the trough to the panel.

32. The apparatus of claim 18 wherein the cavity overlies the other of the panel and back wall.

33. The apparatus of claim 18 wherein the clearance is spaced laterally inwardly from the side edge of the worksurface.

34. The apparatus of claim 18 wherein the back wall of the trough has a top edge adjacent the underside of the worksurface, the access opening is formed in said back wall, and the cavity overlies the access opening.

* * * * *

UNITED STATES PATENT AND TRADEMARK OFFICE

CERTIFICATE OF CORRECTION

PATENT NO. : 5,272,988

DATED : December 28, 1993

INVENTOR(S) : James O. Kelley and Douglas M. DeHaan

It is certified that error appears in the above-indentified patent and that said Letters Patent is hereby corrected as shown below:

In column 2, line 56, after "view" insert -- of --.

In claim 29, column 10, line 8, delete "fastener" and substitute -- fasteners -- therefor.

Signed and Sealed this

Fourth Day of October, 1994

*Attest:*

*Attesting Officer*

BRUCE LEHMAN

*Commissioner of Patents and Trademarks*